US005207432A

United States Patent [19]

Miller

[11] Patent Number: 5,207,432

[45] Date of Patent: May 4, 1993

[54] APPARATUS FOR PLAYING REBOUNDING BALL GAMES

[76] Inventor: Mark Miller, 2625 E. 13th St. Apt. 5F, Brooklyn, N.Y. 11235

[21] Appl. No.: 780,720

[22] Filed: Oct. 21, 1991

[51] Int. Cl.[5] ..... A63B 67/00

[52] U.S. Cl. ..... 273/411; 273/342

[58] Field of Search ..... 273/394, 395, 411, 342; 434/211, 403

[56] References Cited

U.S. PATENT DOCUMENTS

| | | | |
|---|---|---|---|
| 2,430,681 | 11/1947 | Johnson | 273/411 X |
| 2,981,543 | 4/1961 | Peterson | 273/336 |
| 3,133,734 | 5/1964 | Latham | 273/411 |
| 3,452,985 | 7/1969 | D'Zmura | 273/411 X |
| 3,468,038 | 9/1969 | Kennedy | 434/211 |
| 3,671,040 | 6/1972 | Meyer et al. | 273/326 |
| 3,920,245 | 11/1975 | Gothreaux | 273/411 X |
| 4,421,318 | 12/1983 | Sverolik et al. | 273/411 X |
| 4,703,931 | 11/1987 | Steen | 273/411 X |
| 4,905,996 | 3/1990 | Tallent et al. | 273/26 A |

*Primary Examiner*—William H. Grieb

*Attorney, Agent, or Firm*—Emmanuel J. Lobato; Robert E. Burns

[57] ABSTRACT

Apparatus for playing rebounding ball games on a hollow pyramid-shaped structure having three or four solid side surfaces constituting playing surfaces. The pyramid-shaped structure is positioned upright or laid on a side, centrally of a plurality of playing courts corresponding in number to the sides of the structure and each side surface confronting a respective court. The games are played by rebounding a suitable rebounding ball from external playing surfaces or internal playing surfaces of the hollow structure in a corner ball game.

18 Claims, 4 Drawing Sheets

FIG.1
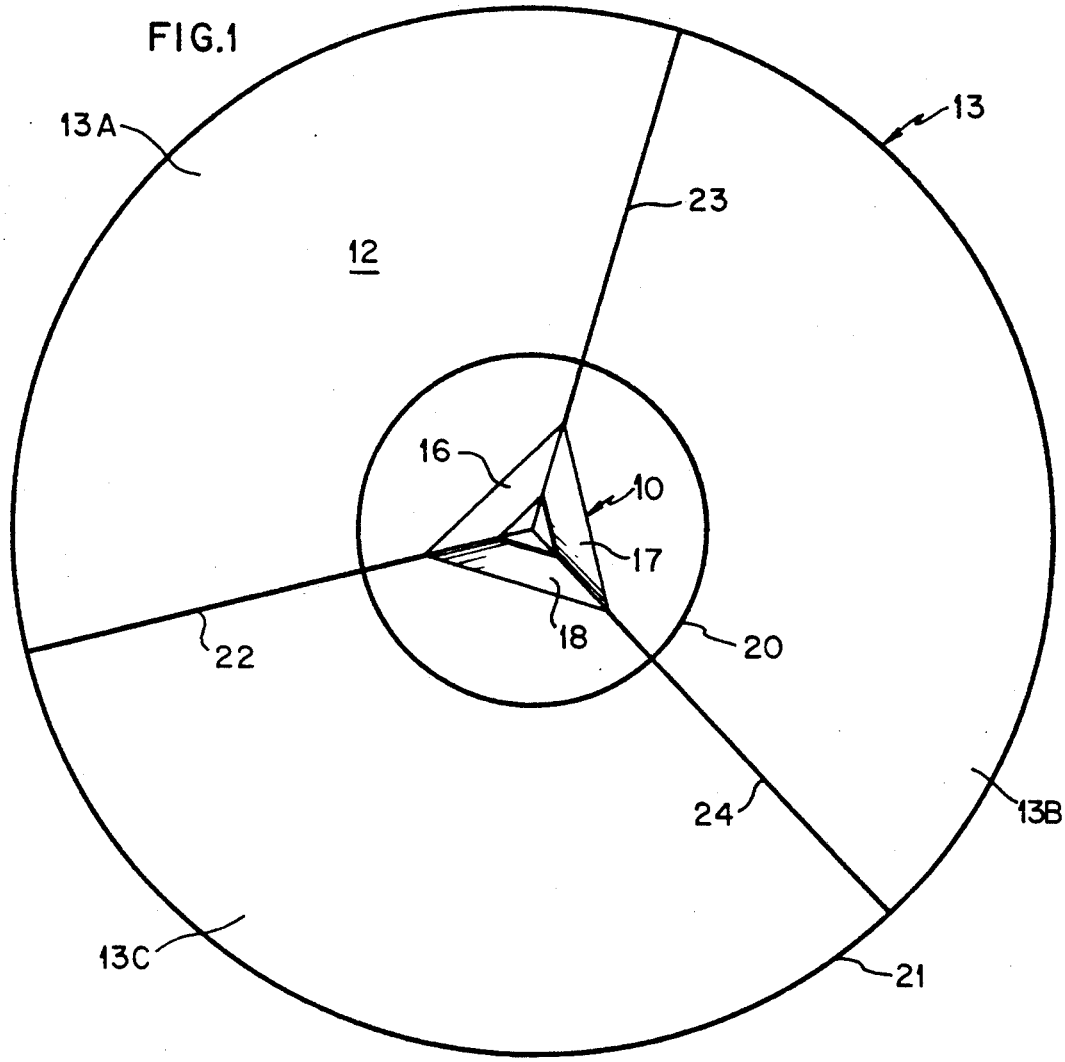
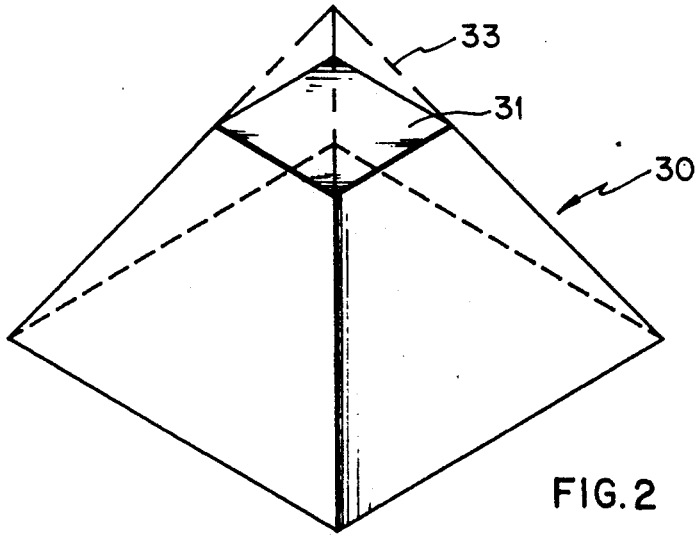
FIG.2

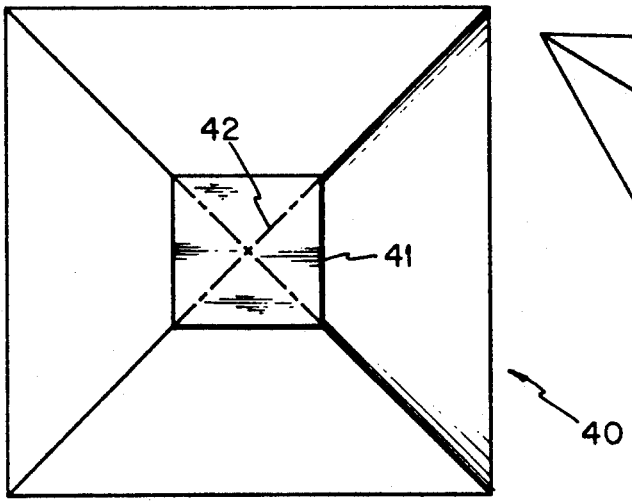
FIG. 3
FIG. 5
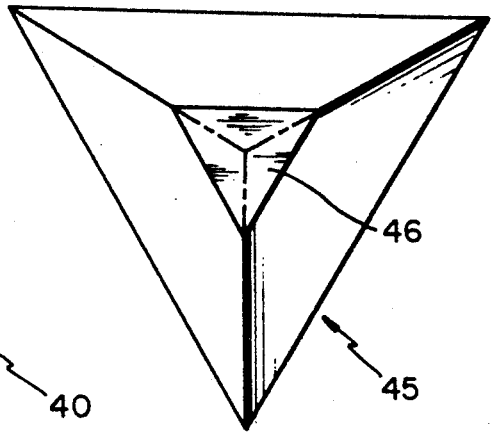
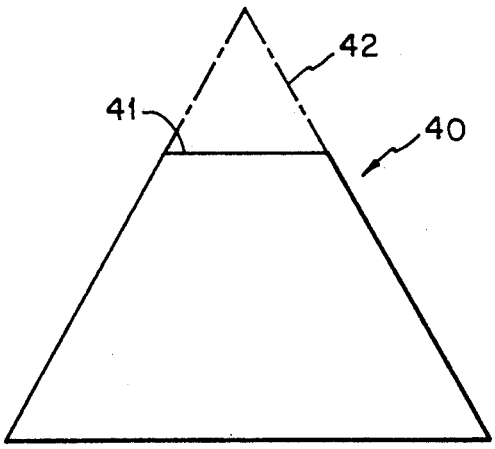
FIG. 4
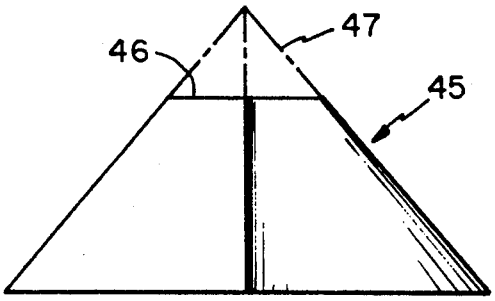
FIG.6
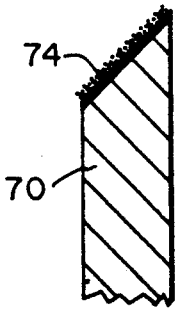
FIG.10
FIG. 9
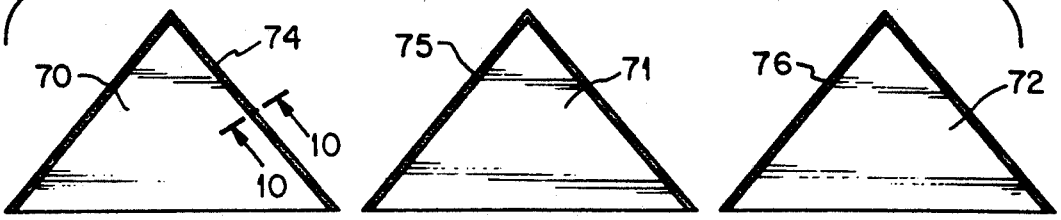

APPARATUS FOR PLAYING REBOUNDING BALL GAMES

The present invention relates in general to ball return games and more particularly to apparatus for playing a novel game using a rebounding ball.

BACKGROUND OF THE INVENTION

Rebounding ball games have been known for years. Children and adults play rebounding ball games using different types of apparatus. A type of corner ball return game is disclosed by U.S. Pat. No. 3,133,734. The game is played by using a paddle and intersecting panels located in the corner of a room. Apparatus for returning or rebounding a ball by using a rebounding net is disclosed in the U.S. Pat. No. 4,703,931; ball and target net apparatus are disclosed in U.S. Pat. No. 4,905,996; and an adjustable rebound apparatus for playing with a rebounding ball is disclosed in the U.S. Pat. No. 4,421,318. The well known hand ball game is played on walls in the open or in enclosures. Games played with a ball on a surface such as a table top with barrier net structures are disclosed in U.S. Pat. No. 3,452,985. A surface rebounding apparatus for rebounding a ball by using a racket and a rebound surface is illustrated in U.S. Pat. No. 3,671,040.

SUMMARY OF THE INVENTION

The apparatus and game disclosed herein are of the competitive action game type wherein a reboundable ball is thrown against a playing surface on a pyramid-shaped structure and can be played by two or more players in a game and several games can be played simultaneously on the same structure.

The game is played on a pyramid-shaped structure without need of paddles or rackets and can be played on a table top, a corner of a room, or on a large or small playing area or field.

A particular feature of the apparatus for playing a rebounding ball game according to the invention is that the pyramid-shaped apparatus is made hollow so that a game can be played thereon with the structure upright and a corner ball game can be played with the hollow structure on its side. In this type of corner ball game the playing ball is thrown into the interior of the structure and the ball rebounded outwardly of the apparatus from the interior wall surfaces which constitute the playing surfaces.

Another feature of the present invention is that the playing structure can be made permanent or portable and can be provided as part of a kit wherein the structure is collapsible or can be a knock-down structure for ease of transporting it.

BRIEF DESCRIPTION OF THE DRAWINGS

The novel features and combination of parts according to the present invention are described hereinafter in the specification and particularly pointed out in the appended claims and accompanying drawings in which:

FIG. 1 is a plan view of a pyramid-shaped structure and playing court for playing games according to the invention;

FIG. 2 is a perspective view of a pyramid-shaped structure for playing games according to the invention;

FIGS. 3 and 4 are a plan view and a side elevation view respectively of a same four-sided pyramid-shaped apparatus for playing ball games according to the invention;

FIGS. 5 and 6 are a plan view and a side elevation view of a same three-sided pyramid-shaped apparatus for playing games according to the invention;

FIG. 9 is a diagrammatic view of a knock-down pyramid-shaped structure according to the invention;

FIG. 10 is a cross section view taken at section line 10—10 of FIG. 9.

DESCRIPTION OF PREFERRED EMBODIMENTS

Figure 7:
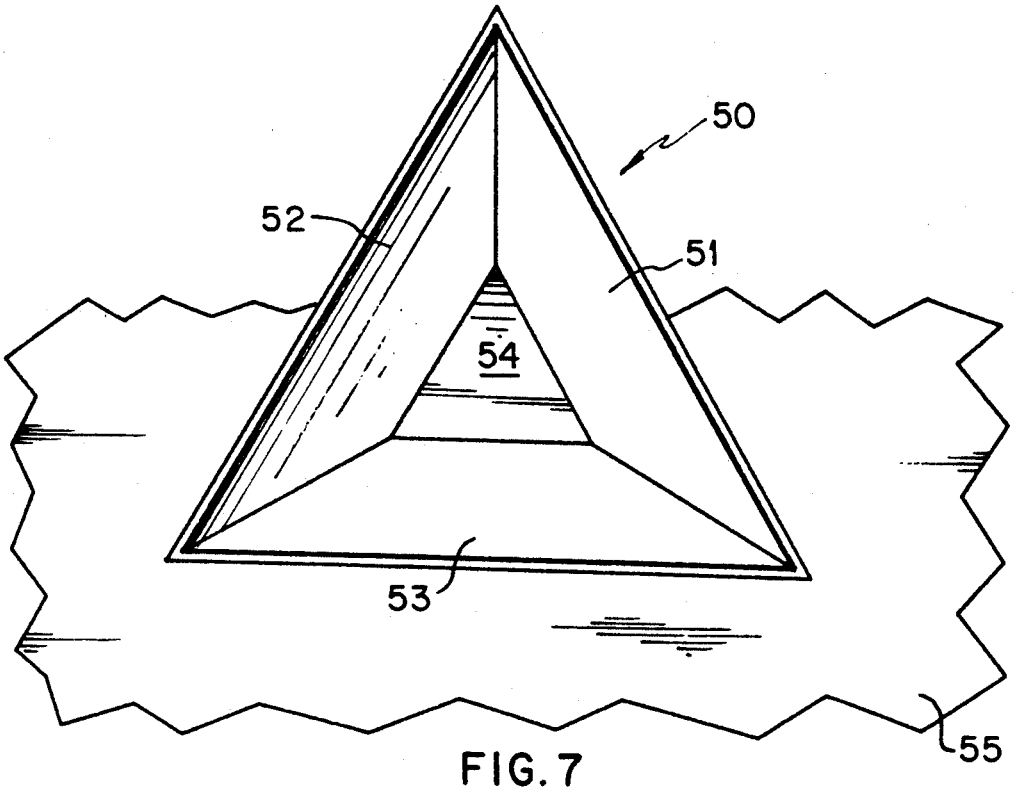
FIG. 7 is a base end internal view of a hollow pyramid-shaped structure, having three sides, illustrating the internal surfaces thereof for playing a corner ball game.

The rebounding ball game is played with a pyramid-shaped structure having either three or four sides. As will be seen hereinafter the structure can be made of different materials and dimensions and the game played with a suitable type of rebounding ball such as a tennis ball.

The pyramid-shaped structure for playing a game is made in different sizes, suitable natural or synthetic materials and made portable or a permanent structure on a playing court or area. The structure has to be made of sufficient weight so that it is stationary as a game is being played thereon. A playing court is illustrated in FIG. 1 in which a three-sided pyramid-shape structure 10 is disposed in a playing area of field 12 on the center of a playing court which is illustrated at 13.

The court 13 is dimensioned as desired for different size playing areas and can be marked by markers made of any suitable material such as a heavy cloth or plastic of sufficient weight to lie flat or by markers sprayed to demark the court. For purposes of the invention the playing court illustrated is dimensioned for use on the grounds of a home or park so that the game can be played outside.

A playing court 13 is divided into three sectors or courts 13A, 13B, 13C of a hundred and twenty degrees each disposed confronting a corresponding plane side surface of the pyramid-shape structure 10. Thus playing surfaces 16, 17 and 18 constituting corresponding sides of the pyramid-shaped structure 10 each face a corresponding playing sector or court 13A, 13B and 13C. The playing court 13 is demarked by an inner circle 20 and an outer circle 21 which constitutes the outer border of the courts.

The two circles 20, 21 have their center at the apex of the pyramid-shaped structure 10. The pyramid-shaped structure 10 is made of a suitable size and the playing courts are demarked in relationship to the structure 10. Thus it will be seen hereinafter that the structure 10 and the playing courts can be dimensioned for playing within a room on the floor and made smaller for playing on a table top.

The game is played with a rebounding ball, for example in the larger structures, a tennis ball can be used and in smaller structures, a ping pong ball can be used. The ball is driven on to a side or face of the structure 10 by the server and fielded on a fly by a defender player. The defender player now has the option of either driving the ball into the face of the playing surface structure in which the game is being played or passing the ball to one of his teammates on another court. And the volleying can continue. The rules of the game can be such that the number of players playing or specific sectors or courts 13A, 13B and 13C can be established and an equal number of defender opposing players will play the game. Of course, the game can be played with the players playing only in one court and using only one face or side of the structure 10 for a two, four or six player game.

A typical game is played with a server standing any place within a specific court. The defender may stand anywhere within the corresponding court in which the game is being played. The ball is thrown against the corresponding playing surface and neither player may deliberately block another player from throwing or receiving of the ball. The server scores if the defender drops the ball or the defender misses the structure. The ball must drop between the inner 20 and outer circle 21 and within the sidelines 22, 23, 24 of the respective court.

The description of the structure 10 and playing court for playing a rebounding ball game on a lot or open field or park is illustrated in FIG. 1. And principles are similar for playing in any outside playing court or area. Thus on a flat area a pyramid-shaped structure 10 is positioned in the playing area and the playing area is demarked by using the apex of the structure 10 for generating the playing court with the three courts 13A, 13B, 13C thereof. In this instance the playing court lines can be demarked by using a marker spray. The dimensions are established with a line temporarily secured or held at the apex of the pyramid-shaped structure 10 and the inner and outer circles developed by simply maintaining the line taut and walking circumferentially around the structure 10 while spraying the lines demarking the inner and outer circles. The three courts are established by straight lines 22, 23, 24 extending radially from the three corners as projections of the three corners of the pyramid-shaped structure 10 and again using the apex as the position from which the side lines are developed.

The structure 10 and court configuration allow for making the pyramid-shaped structure and court dimensions to be determined depending upon the characteristics of the playing area. An example of a pyramid-shaped structure 10 for outdoor playing of a game is a pyramid-shaped structure in which the base of each triangular side of the structure can be in the order of thirty six inches with the pyramid-shaped structure having three equal sides and each side formed as a bilateral triangle in which the two equal sides are twenty five inches. These dimensions will provide a structure having sufficient height and sufficient pyramid surface on each side for playing, on the structure, a fast rebounding ball game.

Using the structure 10 described above the playing court can be demarked with the inner circle ten feet from the apex and the outer most boundary or circle 21 being demarked at thirty feet from the apex. This provides courts that have a twenty foot radial depth.

The playing courts can also be formed from tapes and different size playing courts can be made by use of assembled tapes. Thus the lines described, as to FIG. 1, for demarking the courts can be thought of as actually being suitable tapes assembled and located about the pyramid-shaped structure for playing a rebounding ball game.

With three courts or sectors in a playing court different numbers of players may play in a corresponding court. Thus a game can be played with two players in one court and four players in the other two courts or two players in two courts and four players in the third court. In the event a player is an odd man a single player can play as a neutral player in his own court and the two courts can have two or four players respectively.

The game can be played with court competition using one player per team on each of two courts and four players in the other courts receiving pass balls from the single player.

The rebounding ball game structure can have four sides as shown in pyramid-shaped structure 30 in FIG. 2. The structure configuration may be truncated as shown at 31 or the structure made with a pointed apex 33 as shown. The playing surfaces on all four sides of an individual structure have equal areas and the dimensions can be similar to those heretofore described with a thirty six inch base on each side and similar side dimensions. With this kind of structure the playing court is demarked by inner and outer circles similar to those illustrated in FIG. 1 and each court will be a ninety degree sector of the inner and outer circles and disposed confronting a corresponding flat side playing surface. The structure is, of course, centered in the playing courts similarly to the illustration in FIG. 1.

One aspect of the game structure is that it can be made in different dimensions as shown in FIGS. 3–6 inclusive. Preferably the playing pyramid-shaped structure should have the playing sides of equal dimensions and accordingly equal playing surfaces. This is accomplished as shown in FIGS. 3 and 4 in which a pyramid-shaped structure 40 has four equal sides and can be constructed truncated as shown at 41 or be constructed with each side a complete triangle 42.

Similarly a pyramid-shaped structure 45 with three sides as shown in FIGS. 5 and 6 has the same dimension base as the structures in FIGS. 3 and 4 but is of a lesser height. It likewise can be constructed truncated as shown at 47 or have a complete triangular side configuration 46 in which the base is the same as the structure heretofore described. As to the side surface dimension the height of the playing structure 45 is reduced by making the side dimension shorter.

Those skilled in the art will understand that the larger pyramid-shaped structures are intended for outside use and smaller structures are preferably used for indoor games either on the floor or on tabletops. The rebounding ball game is played with similar rules whether the pyramid-shape structure is formed with an apex or truncated.

Figure 8:
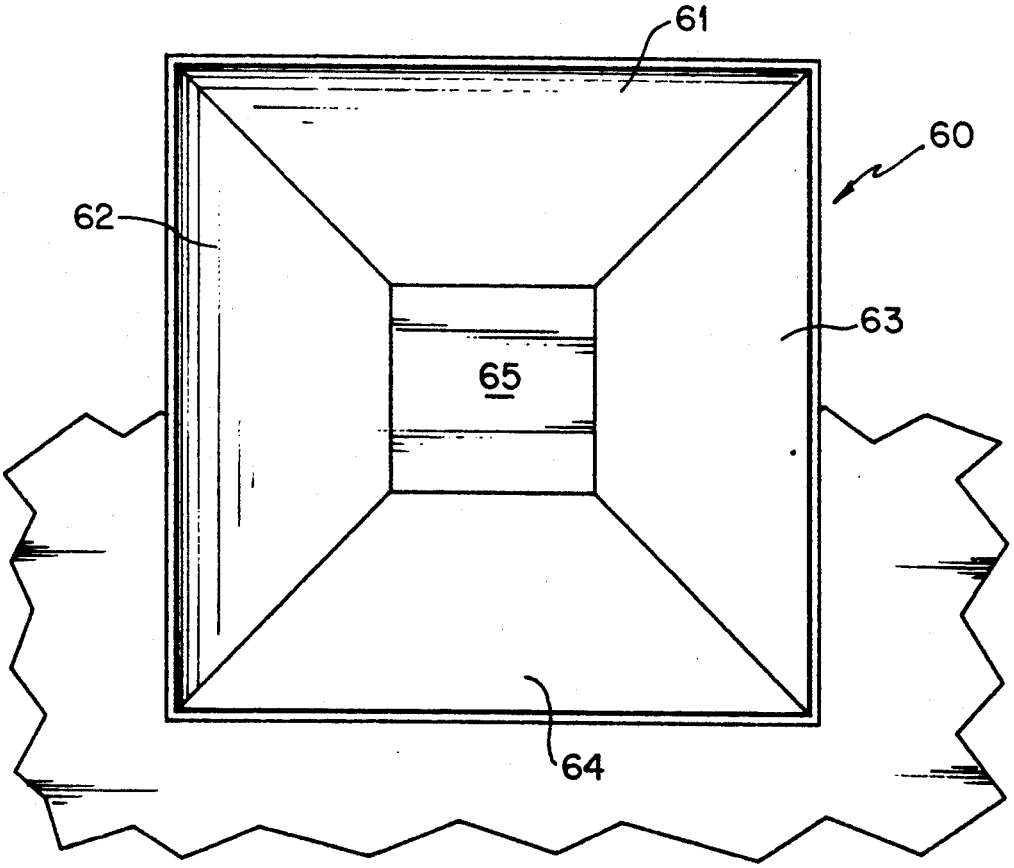
FIG. 8 is a base end internal view of a hollow pyramid-shaped structure according to invention, in which the pyramid-shaped structure has four sides.

A particular aspect of the invention is that each of the pyramid-shaped structures are made hollow. This allows for the playing structure to be laid on its side as shown in FIGS. 7 and 8. In FIG. 7 a three side pyramid-shaped structure 50 is disposed on a side and in FIG. 8 a four-side structure 60 is located on its side. Both of the structures 50, 60 are truncated. The side surfaces are trapezoidal.

In FIG. 7 a playing structure 50 is truncated and has four internal surfaces constituting inner side surfaces 51, 52 and 53 which converge to a flat top inner surface 54. The rebounding ball game is then played as a corner ball game by throwing the ball into the playing structure 50 and rebounding the ball therefrom. Thus the hollow structure provides for a game of corner ball to which similar playing rules can apply. The playing structure 50 is placed on a playing court 55 in which the court is demarked facing the open end of the playing structure and the game played either with the corresponding court demarked or not. In FIG. 7 the court lines are not shown for ease of illustration. A structure on its side can also be used to rebound a ball from the interior surfaces for exercise and practice.

A corner ball game can also be played with pyramid-shaped structures that have four sides as shown in FIG. 8 in which a pyramid-shape 60 has four internal side surfaces 61, 62, 63 and 64 of equal dimension and playing surface area converging towards a flat top surface 65 facing the open end of the pyramid structure 60. The corner ball game is played similarly to the game played with the game structure 50 illustrated in FIG. 7. The ball can be thrown against any of the five internal surfaces for rebounding and can be tossed so that it can be rebound from one internal surface to the other in order to complicate the game for the defending player or players. Of course, corner ball games can be played with pyramid-shaped playing structures that are not truncated, The playing structures thus are used upright or laid on a side thereof to play different types of games.

The game and playing structures arrangement according to the invention is provided in kit form as well as fixed and permanent structures. The kit provides for the sides of a pyramid-shaped structure, as shown in FIG. 9, which is a knock-down assembly of sides 70, 71, and 72 which are formed or configured as triangles. The three sides 70–72 are of equal dimension for forming a three sided pyramid-shaped structure when assembled. Each of the sides 70–72 is provided with VELCRO as shown at 74, 75, and 76. Each side has the VELCRO along the boundary of the triangular sides so that the three sides can be assembled into a unit in the form of a hollow structure of the type illustrated and described above.

Provision is made in the kit for the knock-down assembly as shown in FIG. 9 and FIG. 10, for playing a game. The kit is provided with marking material and/or tapes which can be assembled to demark the courts as described heretofore.

Figure 11:
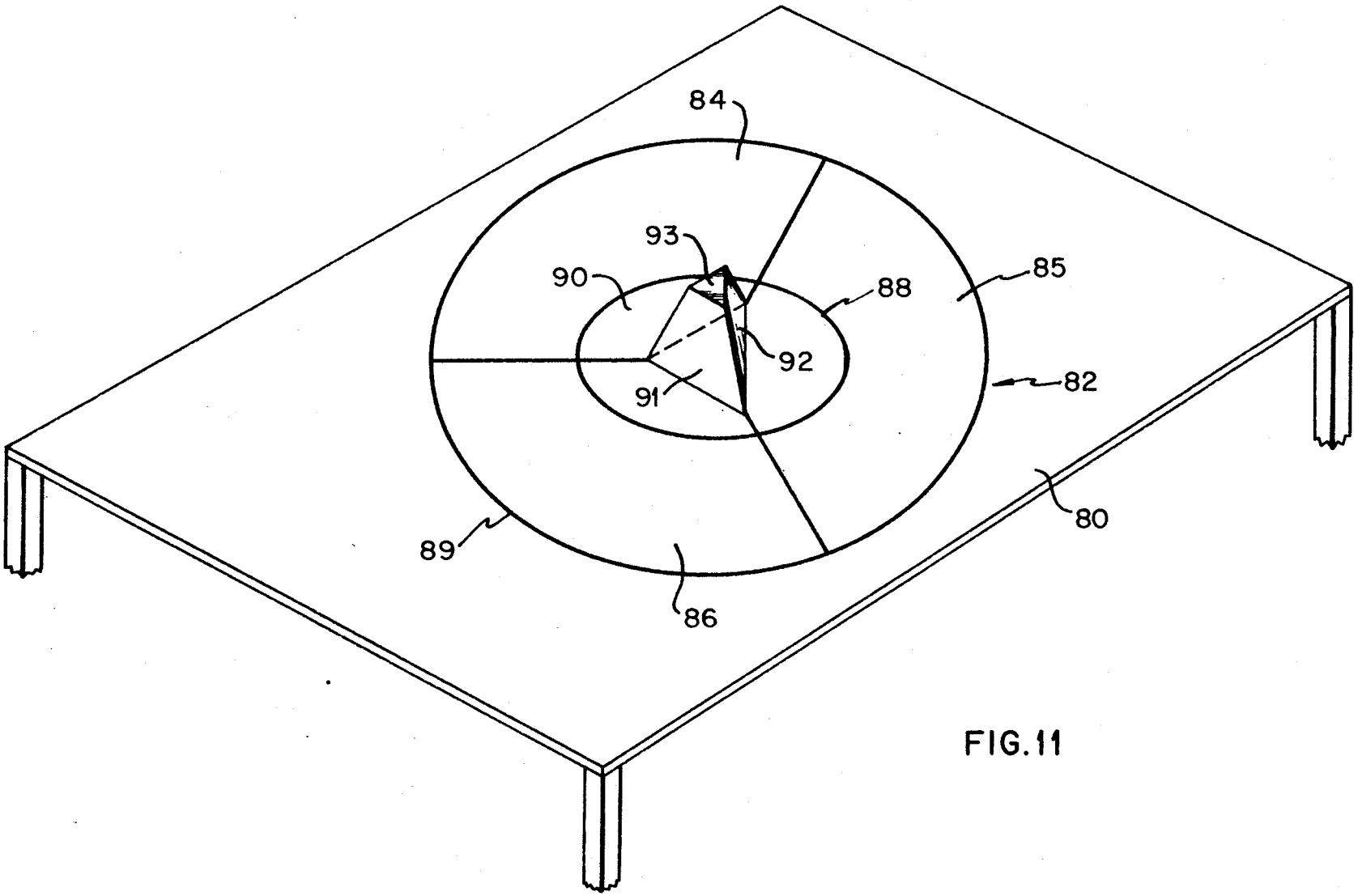
FIG. 11 is a diagrammatic perspective view of an embodiment of a pyramid-shaped structure and playing table top for playing according to the invention.

The invention provides for playing a rebounding ball game on a table top. For example, as shown in FIG. 11 diagrammatically. A table 80, for example a PING PONG table, has a court marker 82 divided into three courts 84, 85, 86 having an inner boundary 88 and an outer circle boundary 89 so that the playing surface between the circles in each court provide the playing court. A pyramid-shaped structure 90 having three sides is centered in the court marker 82. Each side 91, 92, 93 of the pyramid-shaped structure 90 faces a corresponding court as heretofore explained with respect to FIG. 1.

For tabletop playing of the rebounding ball game according to the invention a PING PONG ball is used. The ball is thrown against a corresponding playing surface or side and the ball must be served and caught within the corresponding court space, for example the court space 86.

Of course, the pyramid-shaped structure is made hollow and can be laid on a side so that a corner ball game can be played by delivering a PING PONG ball into an open base of the structure 90 and bounced out through the open base as heretofore described with respect to corner ball games. This type of playing arrangement is likewise provided in a kit or otherwise. The pyramid-shaped structure can be an assembled structure or a knock-down structure as described.

Those skilled in the art will understand that the table top marker 82 can be made as a suitable mat. The marker or mat 83 can be made without the outer circle 89 and the size thereof can be the inner circle 88 for use on a round table top, not shown, in which case the edge of the round table top is the outer boundary of the court. A small playing structure can also be made for playing the game on a desk.

As heretofore mentioned the pyramid-shaped playing structures and courts for playing rebounding ball game are dimensioned in accordance with the site to be used, such as outdoors in a room or table top. The pyramid-shaped structures are made multi-lateral with the sides being triangular or trapezoidal. A wide range of dimensions may be used for the structures and the courts. The angle between the base and each of the sides of the structures, however, can be optimized depending on the court size since the inclination of a playing surface, a side of a structure, along with the rebounding characteristics of a ball and the velocity of the ball deliveries on to a surface affect the return of the thrown playing ball. The following tables I and II provide guides as to dimensions of some usable pyramid structures. The inclination angle is defined by the internal angle between a given side and a flat horizontal surface on which a playing structure is disposed for playing. All the sides, triangular or trapezoidal, of a given pyramid-shaped structure have the same inclination angle. The inclination can be set in a range of 40° to 65° and a range 45° to 52° is excellent for these rebounding ball games. The structure dimensions will depend on the playing area in which it will be used.

TABLE I

| THREE SIDE PLAYING STRUCTURES (TRIANGULAR SIDES) DIMENSIONS OF EACH SIDE | | |
|---|---|---|
| BASE | SIDES | INTERNAL ANGLE OF INCLINATION |
| 36" | 22" | 35° |
| 36" | 24" | 49° |
| 36" | 22.5" | 54° |
| 36" | 30" | 64° |
| 36" | 33" | 68° |
| 36" | 35" | 70° |
| 36" | 36" | 71° |

TABLE II

| FOUR SIDE PLAYING STRUCTURES (TRAPEZOIDAL SIDES) DIMENSIONS OF EACH SIDE | | |
|---|---|---|
| BASE | SIDES | INTERNAL ANGLE OF INCLINATION |
| 36" | 20" | 35° |
| 36" | 22" | 42° |
| 36" | 25.5" | 54° |
| 36" | 30" | 70° |

The angle of inclination is also the internal angle between the base of a playing structure and the internal flat surface of each side, triangle or trapezoid, that defines a respective playing surface of a playing structure.

What I claim is:

1. Apparatus for playing rebounding ball games comprising, a pyramid-shaped structure having at least three essentially flat sides defining playing surfaces, each playing surface constituting a solid surface on which a game is playable by throwing a reboundable ball on to the playing surface and rebounding the ball therefrom, the pyramid-shaped structure being disposed in use resting on a substantially flat playing area, demarking means for demarking the playing area into a plurality of playing courts comprising means for defining a circle circumferentially of the structure defining an outer boundary of the playing courts and means for dividing the playing area into a number of playing courts corresponding to the number of playing surfaces and corresponding to the number of said sides of said pyramid-shaped structure, each of said playing courts being defined along one side thereof by a base of a corresponding playing surface, said demarking means comprising means for defining sides of each court diverging radially from a corner of a base of a corresponding playing surface and terminating at said outer boundary, and means defining a circle internally of the outer circle of the playing courts circumferentially of the pyramid-shaped structure thereby defining an inner boundary of the individual courts.

2. Apparatus for playing rebounding ball games according to claim 1, in which said sides are equally dimensioned and thereby said solid playing surfaces are equally dimensioned.

3. Apparatus for playing rebounding ball games according to claim 1, in which said pyramid-shaped structure is portable and said sides thereof comprise a knock-down assembly which can be reassembled.

4. Apparatus for playing rebounding ball games according to claim 1, in which said pyramid-shaped structure is hollow.

5. Apparatus for playing rebounding ball games according to claim 1, in which said pyramid-shaped structure is disposed stationary on said playing area.

6. Apparatus for playing rebounding ball games according to claim 1, in which said pyramid-shaped structure is disposed as a permanent structure on said playing area.

7. Apparatus for playing rebounding ball games according to claim 1, in which said demarking means for demarking said playing area courts comprises tapes disposed in use on said substantially flat playing area defining said outer circle, said inner circle and said sides of said courts.

8. Apparatus for playing rebounding ball games according to claim 1, in which said demarking means for demarking said playing area comprises means for effectively defining said courts and inner and outer boundaries thereof by spray marker material.

9. Apparatus for playing rebounding ball games including corner ball games comprising, a hollow, pyramid-shaped rigid structure having exterior and interior side surfaces for rebounding a ball therefrom and an open base, said hollow pyramid-shaped structure being positionable upright in use for playing rebounding ball games by throwing of a rebounding ball by players on to said exterior side surfaces thereof and alternatively positionable on a side thereof with said open base facing a playing area from which players throw a rebounding ball through said open base into the interior of the hollow pyramid-shaped structure for rebounding the ball from interior surfaces of said pyramid-shaped structure and outwardly through said open base toward said playing area, and means for delineating that area.

10. Apparatus for playing rebounding ball games including corner ball games comprising, a hollow, pyramid-shaped rigid structure having an open base, and said hollow pyramid-shaped structure being positioned upright in use for playing rebounding ball games on exterior side surfaces thereof and alternatively positionable on a side thereof with said open base facing a playing area from which at least one player can throw a rebounding ball through said open base into the interior of the hollow pyramid-shaped structure for rebounding the ball from interior surfaces of said pyramid-shaped structure and outwardly through said open base toward said playing area, means for demarking the playing area into a playing court comprising means for defining an outer boundary of said court removed from the open base, means for defining an inner boundary of said court, and means for defining sides of said court.

11. Apparatus for playing rebounding ball games including corner ball games comprising, a hollow, pyramid-shaped rigid structure having an open base, and said hollow pyramid-shaped structure being positioned upright in use for playing rebounding ball games on exterior side surfaces thereof and alternatively positionable on a side thereof with said open base facing a playing area from which at least one player can throw a rebounding ball through said open base into the interior of the hollow pyramid-shaped structure for rebounding the ball from interior surfaces of said pyramid-shaped structure and outwardly through said open base toward said playing area, said court being wedge-shaped and the sides thereof diverge from corners of said open base.

12. A kit for playing rebounding ball games comprising, an assemblable portable hollow, pyramid-shaped knock-down structure having when assembled, at least three equally dimensioned flat sides each defining a corresponding playing surface, each playing surface constituting a surface on which a corresponding rebounding ball game is playable by throwing a rebounding ball on to said playing surface and rebounding the ball therefrom, the pyramid-shaped structure positioned in use upright on a substantially level playing area, and said kit including portable means for demarking the playing area into at least one court for playing rebounding ball games.

13. A kit for playing rebounding ball games comprising, a portable hollow, pyramid-shaped structure having at least three equally dimensioned flat sides each defining a solid corresponding playing surface, each playing surface constituting a surface on which a corresponding rebounding ball game is playable by throwing a rebounding ball on to said playing surface and rebounding the ball therefrom, the pyramid-shaped structure positioned in use upright on a substantially level playing area, and portable means for demarking the playing area into at least one court for playing a rebounding ball game, said pyramid-shaped structure having a base for disposing the pyramid-like structure upright, and in which said means for demarking the playing area comprises means for defining playing courts equal in number to the playing surfaces of said pyramid-shaped structure, and said pyramid-shaped structure is positioned on the playing courts upright so that each playing surface confronts a corresponding playing court, whereby one or up to three rebounding ball games are playable each on a corresponding playing surface of the pyramid-shaped structure.

14. A kit for playing rebounding ball games according to claim 13, in which said pyramid-shaped structure has an open base and is alternatively disposed in use on a side thereof with said open base facing a playing court for playing a corner ball games on said pyramid-shaped structure by throwing the rebounding ball through said open base into the interior of said pyramid-shaped structure against interior surfaces thereof and rebounding said ball out through said open base.

15. A kit for playing rebounding ball games according to claim 14, in which said pyramid-shaped structure has four sides defining four playing surfaces.

16. A kit for playing rebounding ball games according to claim 13, in which said means for defining said playing area comprises a table top.

17. A kit for playing rebounding ball games according to claim 16, in which said means for defining playing courts comprises a mat disposed on said table top.

18. A kit for playing rebounding ball games according to claim 13, in which said pyramid-shaped structure sides are a knock-down assembly which can be reassembled.

* * * * *